US007484487B2

(12) United States Patent
Zurface et al.

(10) Patent No.: US 7,484,487 B2
(45) Date of Patent: Feb. 3, 2009

(54) DUAL LIFT ROCKER ARM LATCH MECHANISM AND ACTUATION ARRANGEMENT THEREFOR

(75) Inventors: Austin R. Zurface, Hastings, MI (US); Andrew P. Harman, Battle Creek, MI (US); Kynan L. Church, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/284,269

(22) Filed: Nov. 21, 2005

(65) Prior Publication Data

US 2007/0186890 A1 Aug. 16, 2007

(51) Int. Cl.
*F01L 1/18* (2006.01)

(52) U.S. Cl. ..... 123/90.39; 123/90.2; 123/90.44; 74/559

(58) Field of Classification Search ..... 123/90.39, 123/90.44, 90.6, 90.16, 90.2, 90.27, 90.31, 123/90.33, 90.36; 74/559, 567, 569
See application file for complete search history.

(56) References Cited

U.S. PATENT DOCUMENTS 5,544,626 A 8/1996 Diggs et al.
5,655,488 A 8/1997 Hampton et al.
5,975,251 A * 11/1999 McCarthy ..... 188/31
6,615,782 B1 * 9/2003 Hendriksma et al. ..... 123/90.39
6,668,779 B2 12/2003 Hendriksma et al.

FOREIGN PATENT DOCUMENTS

EP 0733783 9/1996
WO WO 2004/094791 11/2004

OTHER PUBLICATIONS

PCT Search Report dated Jul. 11, 2007 for International Application No. PCT/IB2006/003292.

* cited by examiner

*Primary Examiner*—Ching Chang
(74) *Attorney, Agent, or Firm*—Anna M. Shih

(57) ABSTRACT

A valve control system including a camshaft having first and second cam profiles, the valve control system comprising a rocker arm assembly (11) including a first rocker arm (13) having a first cam follower (15) in engagement with the first cam profile, and a second rocker arm (17) having a second cam follower (23,25) in engagement with the second cam profile. The engine includes a fulcrum location (P) operable to provide a source of pressurized fluid, and the first rocker arm includes a latch member (47) moveable between latched (FIG. 6) and unlatched conditions. The latch member is biased toward the latched condition by a fluid pressure in a chamber (51), and the first rocker arm defines a fluid passage (55) having a first end (57) in open fluid communication with the pressure source, and a second end (59) in open fluid communication with the pressure chamber (51).

8 Claims, 5 Drawing Sheets

DUAL LIFT ROCKER ARM LATCH MECHANISM AND ACTUATION ARRANGEMENT THEREFOR

BACKGROUND OF THE DISCLOSURE

The present invention relates to valve control systems for internal combustion engines of the type in which the movement of an engine poppet valve is controlled in response to rotation of a cam shaft, and more particularly, to such a valve control system in which the cam shaft has a cam profile including both a high lift portion and a low lift portion.

Even more specifically, the present invention relates to such a valve control system including a dual lift rocker arm assembly of the type having both a high lift cam follower and a low lift cam follower (for engagement with the high lift portion and the low lift portion, respectively, of the cam profile). Although the terms "high lift" and "low lift" can have various meanings when used in regard to valve control systems for engine poppet valves, it should be understood that, within the scope of the present invention, all that is required is that one cam profile provide a relatively higher lift of the engine poppet valve while the other cam profile provides a relatively lower lift of the engine poppet valve. Within the scope of the invention, the "low lift" could actually comprise zero lift, or could comprise some finite lift amount which is greater than zero lift, but somewhat (or substantially) less than the "high lift".

In a typical dual lift rocker arm assembly, of the type which is now well known in the art, there is provided an outer rocker arm and an inner rocker arm, with those two rocker arms typically being pivotally connected relative to each other toward one axial end thereof. In addition, the typical, prior art dual lift rocker arm assembly includes some sort of latch mechanism, operable to latch the inner rocker arm to the outer rocker arm, such that the two rocker arms move in unison about a fulcrum location, such as the ball plunger of a hydraulic lash adjuster. This "latched" condition, as described above, would typically, but not necessarily, correspond to the high lift mode of operation of the valve control system. When the latch mechanism is in the "unlatched" condition, the inner and outer rocker arm are free to pivot relative to each other, and this unlatched condition would typically, but not necessarily, correspond to the low lift mode of operation of the valve control system.

Dual lift, latchable rocker arm assemblies are illustrated and described in U.S. Pat. Nos. 5,524,580; 5,584,267; and 5,697,333, all of which are assigned to the assignee of the present invention, and incorporated herein by reference.

In the dual lift rocker arm assemblies of the above-incorporated patents, there is provided some sort of electromagnetic actuator for controlling the operation of the latching mechanism. Although such electromagnetic actuation of the latching mechanism has been found to operate in a generally satisfactory manner, the resulting need for a separate electromagnetic actuator for each rocker arm assembly would add substantially to the cost of the overall valve control system, and in many applications, would require much more space for "packaging" than is available in the typical engine cylinder head.

Those skilled in the art have attempted to provide a means of actuation for the latching mechanism of a dual lift rocker arm assembly, which would overcome the prior art problems discussed above, by utilizing hydraulic pressure. Specifically, those skilled in the art have attempted to utilize, to control the latching mechanism, a variable hydraulic pressure within the plunger of the hydraulic lash adjuster, which serves as the fulcrum location for the rocker arm assembly. Such an actuation arrangement is illustrated and described in U.S. Pat. Nos. 5,544,626 and 6,668,779, both of which are incorporated herein by reference.

Although the rocker arm assemblies of the above-incorporated patents, in the immediately preceding paragraph, do provide at least the potential for substantially improved actuation of the latching mechanism, the need to communicate the low pressure (control) fluid from the lash adjuster to the latching mechanism has somewhat complicated the design of the rocker arm assembly. This is especially true when it is recognized that there are various other design criteria for rocker arm assemblies which must be observed, in order to achieve the best possible overall performance of the valve control system. For example, in order to improve the dynamic behavior of the valve control system, it is desirable to reduce the inertia of the rocker arm assembly. One way of reducing the inertia is to locate as much of the mass of the rocker arm assembly as close as possible to the fulcrum location. Therefore, it is recognized that it is desirable to have the pivot axis, between the inner and outer rocker arms, disposed adjacent the fulcrum location, such that the torsion spring, which biases the rocker arms relative to each other, may also be near the fulcrum location.

Unfortunately, in the dual rocker arm assembly of the above-incorporated U.S. Pat. No. 6,668,779, in order to utilize a control fluid from the hydraulic lash adjuster to control the latching mechanism, it was necessary to add a piston member (the only function of which was to move in response to changes in control pressure), with the movement of the piston member being transmitted from the piston member to the latching mechanism at the opposite end of the rocker arm assembly by means of a separate slider element, having no function other than to move the latching mechanism in response to movement of the piston member. The added cost and complexity of the arrangement in the rocker arm assembly of the '779 patent, as well as the added mass and inertia of the assembly, make the overall assembly less than desirable commercially.

BRIEF SUMMARY OF THE INVENTION

Accordingly, it is an object of the present invention to provide an improved valve control system, for controlling engine poppet valves, wherein the system is of the type including a dual lift rocker arm assembly which is able to overcome the above-discussed disadvantages of the prior art.

It is a more specific object of the present invention to provide such an improved dual lift rocker arm assembly in which the latching mechanism is controlled by pressurized fluid from the hydraulic lash adjuster, but which does not require substantial added structure, cost, and weight in order to transmit changes in fluid pressure into movement of the latch mechanism.

The above and other objects of the invention are accomplished by the provision of a valve control system for an internal combustion engine of the type including a cylinder head, and a poppet valve moveable relative to the cylinder head between open and closed positions, and a cam shaft having a first cam profile and a second cam profile formed thereon. The valve control system comprises a rocker arm assembly including a first rocker arm having a first cam follower in engagement with the first cam profile, and a second rocker arm having a second cam follower in engagement with the second cam profile. The valve control system further comprises the cylinder head including a fulcrum location operable to provide a source of pressurized fluid. The first rocker arm defines, toward a first axial end thereof, a fulcrum surface adapted for pivotal engagement with the fulcrum location. The first rocker arm further defines, adjacent the fulcrum surface, a pivot location whereby the second rocker arm pivots relative to the first rocker arm about the pivot location. The first rocker arm includes, toward a second axial end thereof, a latch assembly including a latch member moveable between latched and unlatched conditions, relative to a latch surface defined by an adjacent portion of the second rocker arm. A spring biases the latch member toward one of the latched and unlatched conditions, and the latch assembly defines a pressure chamber operable to bias the latch member toward the other of the latched and unlatched conditions.

The improved valve control system is characterized by the first rocker arm defining a fluid passage having a first end in open fluid communication with the fulcrum surface, the first end of the fluid passage being operable to receive pressurized fluid from the source. The fluid passage has a second end in open fluid communication with the pressure chamber of the latch assembly.

DETAILED DESCRIPTION OF THE PREFERRED EMBODIMENT

Figure 1:
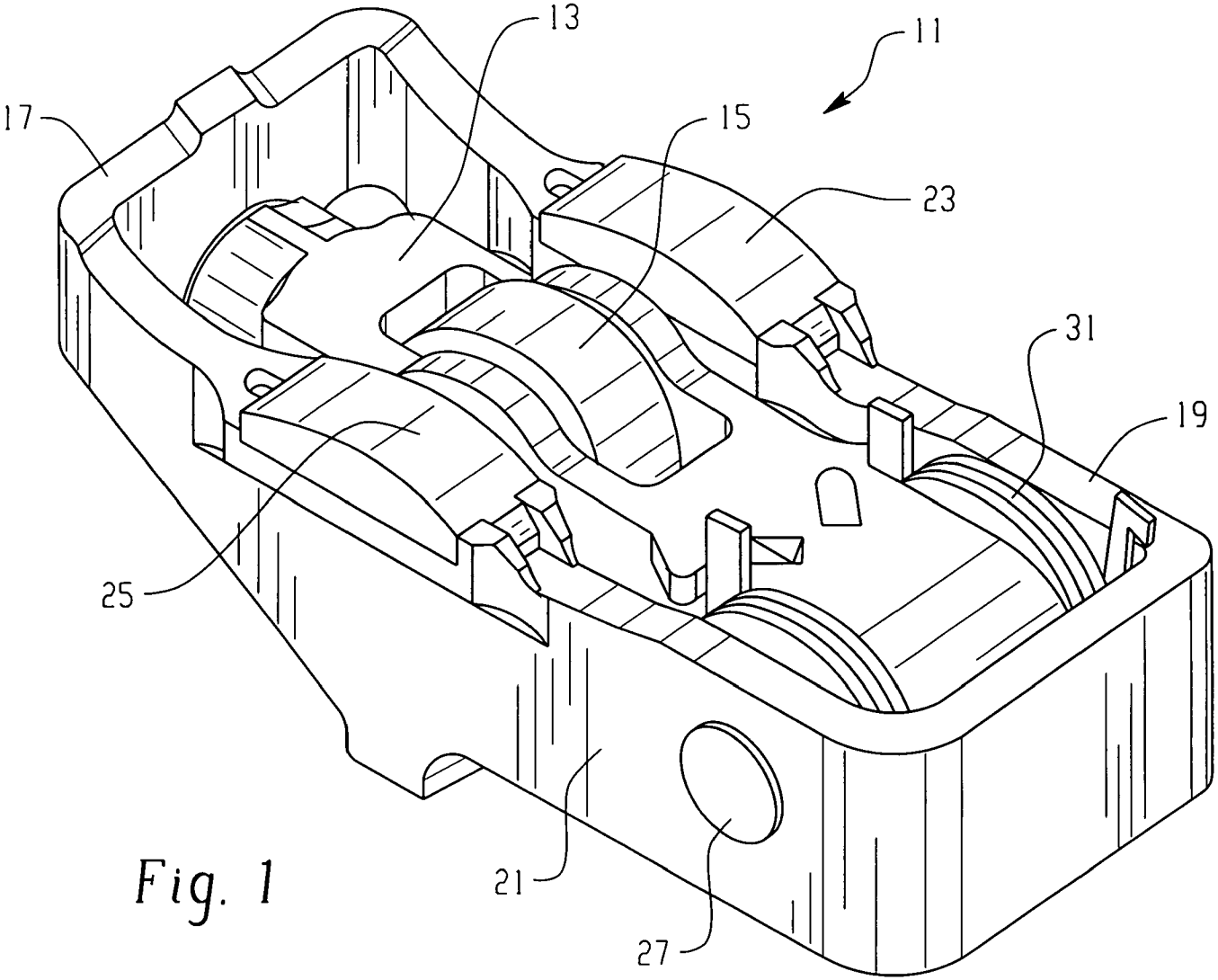
FIG. 1 is a perspective view of a dual lift rocker arm assembly of the type which may utilize the present invention.

Referring now to the drawings, which are not intended to limit the invention, FIG. 1 illustrates a dual lift rocker arm assembly, generally designated 11, of the general type illustrated and described in U.S. Pat. No. 5,655,488, assigned to the assignee of the present invention and incorporated herein by reference. One reason for referring to the incorporated patent is that it shows the cam shaft, including the high lift and low lift cam profiles, as well as a portion of the cylinder head, and also shows the engine poppet valve, none of which are illustrated herein, for the sake of simplicity, and because such elements are well known to those skilled in the art, and do not require detailed description.

Referring still to FIG. 1, the dual lift rocker arm assembly 11 of the present invention comprises an inner rocker arm 13 (also referred to hereinafter in the appended claims as a "first" rocker arm). The inner rocker arm 13 includes a roller follower 15 which, in the subject embodiment, would comprise the "low lift" cam follower, and would engage the low lift cam profile on the cam shaft. As may best be seen in FIG. 6, the roller follower 15 rotates about an axis designated "a".

Referring still primarily to FIG. 1, the dual lift rocker arm assembly 11 further comprises an outer rocker arm 17 (also referred to hereinafter in the appended claims as a "second" rocker arm). The outer rocker arm 17 includes a pair of sidewalls 19 and 21, disposed on laterally opposite sides of the inner rocker arm 13. The sidewalls 19 and 21 include a pair of pad portions 23 and 25, respectively, and the pad portions 23 and 25 would comprise the "high lift" cam follower, and would engage the high lift cam profile on the cam shaft. As is well known in the art, the high lift cam profile, for use with the dual lift rocker arm assembly 11, would comprise a pair of cam profiles, disposed on either side, axially, of the low lift cam profile.

Figure 2:
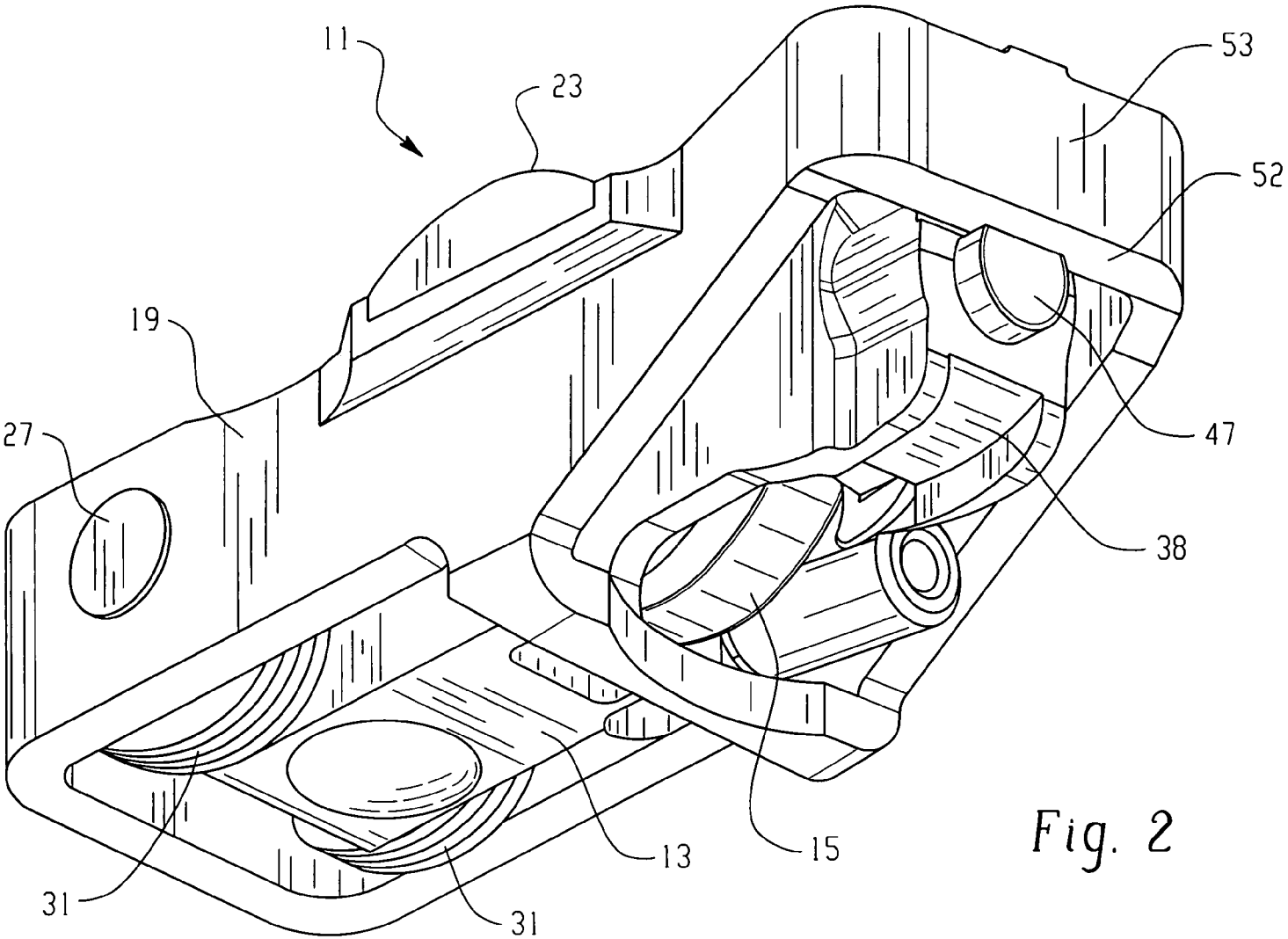
FIG. 2 is a perspective view of the rocker arm assembly of FIG. 1, but taken from the opposite end, and looking upward.

As may best be seen in FIGS. 1 and 2, the inner and outer rocker arms 13 and 17 are connected to each other, for relative pivotal movement, by means of a transversely-oriented shaft 27. The shaft 27 (also shown in FIGS. 4 and 5), has its end portions received within openings in the sidewalls 19 and 21 of the outer rocker arm 17 and has its middle portion disposed within a circular opening 29 (see FIGS. 3 and 4) defined by the inner rocker arm 13. In a surrounding relationship to portions of the shaft 27, on either lateral side of the inner rocker arm 13, are several turns of a torsion spring 31, shown only in FIGS. 1 and 2. As is well known to those skilled in the art, the purpose of the torsion spring 31 is to bias the inner rocker arm 13 counterclockwise in FIG. 1, relative to the outer rocker arm 17, about the shaft 27.

Figure 3:
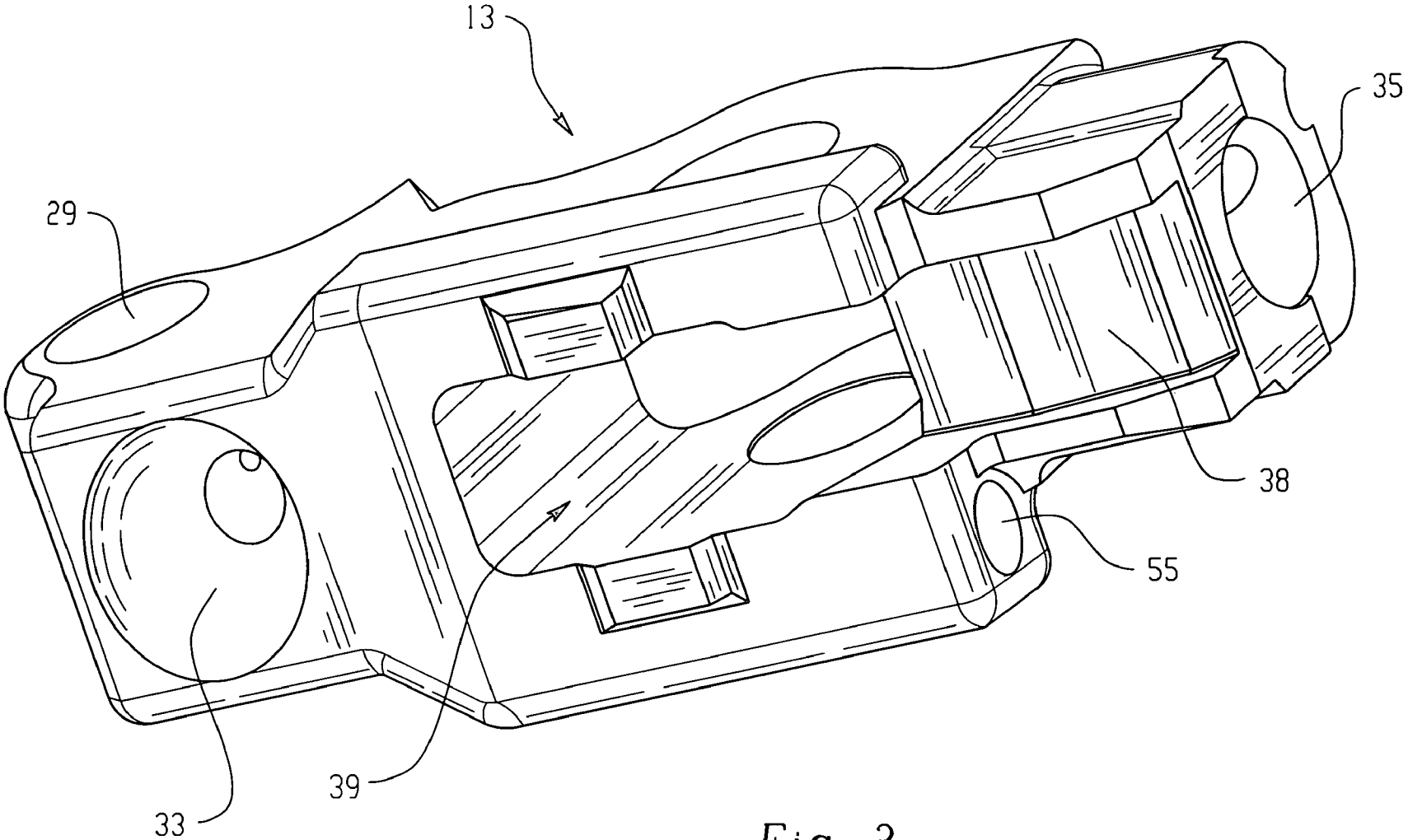
FIG. 3 is a view generally similar to that of FIG. 2, but showing only the inner rocker arm, and taken at a slightly different angle than FIG. 2.

Referring now primarily to FIG. 3, the inner rocker arm 13 preferably comprises a single, unitary item which may be produced as a casting and subsequently machined, or may be produced as a powdered metal part. It should be understood by those skilled in the art that the present invention is not limited to the particular configuration of, or the process for manufacture of, the inner rocker arm 13, and the configuration shown herein is by means of example only, except as will be noted hereinafter and in the appended claims.

The inner rocker arm 13 defines a generally hemispherical fulcrum surface 33 which, as is well known to those skilled in the art, is adapted for engagement with a member which serves as a "fulcrum location". By way of example only, the fulcrum location can comprise a ball plunger portion (identified as "P" in FIG. 4) of a hydraulic lash adjuster, such that both the ball plunger portion and, where appropriate, the hydraulic lash adjuster itself ("fulcrum location"), may hereinafter bear the reference designation "P". As is also now well known to those skilled in the art, the hydraulic lash adjuster is typically received within a cylindrical bore defined by the engine cylinder head (not shown herein for ease of illustration).

Figure 4:
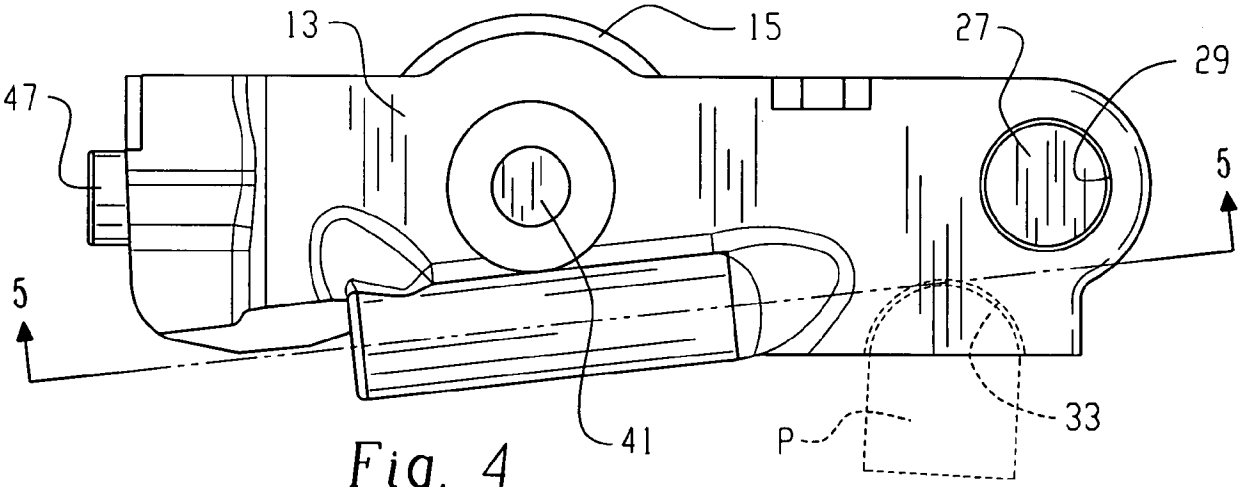
FIG. 4 is a side plan view, looking toward the side which is on the bottom in FIG. 3, showing primarily only the inner rocker arm.
Figure 5:
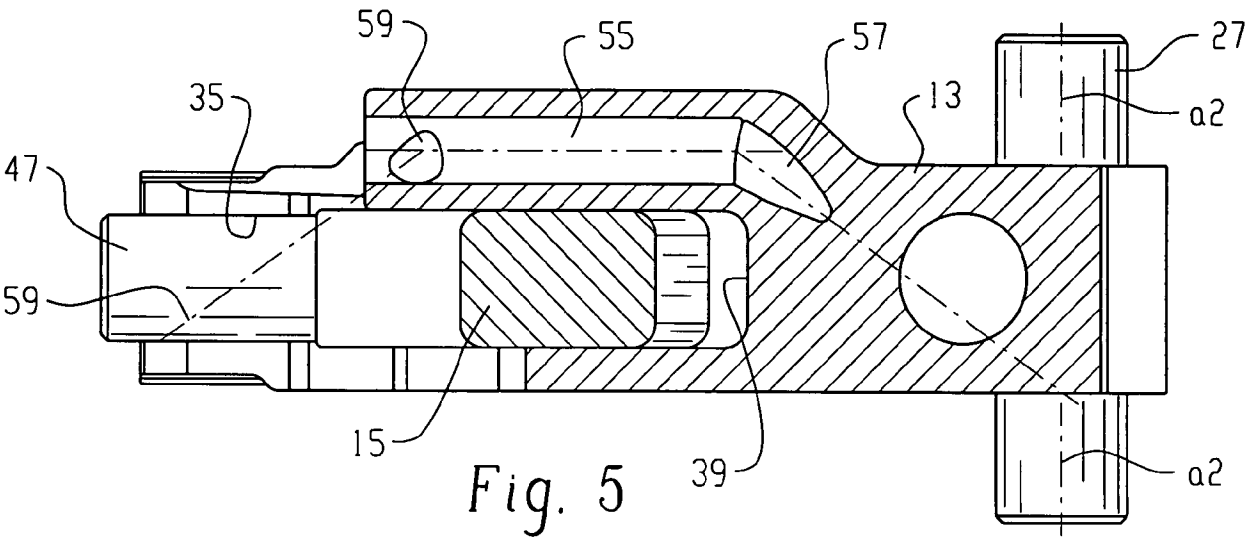
FIG. 5 is an axial cross-section, taken generally on line 5—5 of FIG. 4, of the inner rocker arm, including the fluid passage which comprises one important aspect of the invention.

Referring now primarily to FIGS. 1, 3 and 5, the inner rocker arm 13 defines, at its end axially opposite the circular opening 29, a latch bore 35, and disposed within the latch bore 35 is a latch assembly, generally designated 37 (shown only in FIG. 6), and to be described in greater detail subsequently. It may be seen in FIG. 6 that the inner rocker arm 13 defines a valve pad 38 (also shown in FIG. 2) for engagement with the valve stem tip portion of the poppet valve. Disposed intermediate the opening 29 and the latch bore 35, the inner rocker arm 13 defines a central open chamber 39 (see also FIG. 3), the roller follower 15 being disposed in the open chamber 39, rotatably mounted upon a roller shaft 41 (see FIG. 4). Although the present invention is not limited to use with any particular configuration of rocker arm assembly, except where specifically otherwise noted in the appended claims, the invention is especially useful in the dual lift rocker arm assembly 11, of the type shown herein, in which the fulcrum surface 33 is disposed toward one axial end of the inner rocker arm 13, and the latch bore 35 is disposed toward the opposite axial end, with the roller follower 15 disposed axially therebetween, for reasons which will become apparent subsequently.

Figure 6:
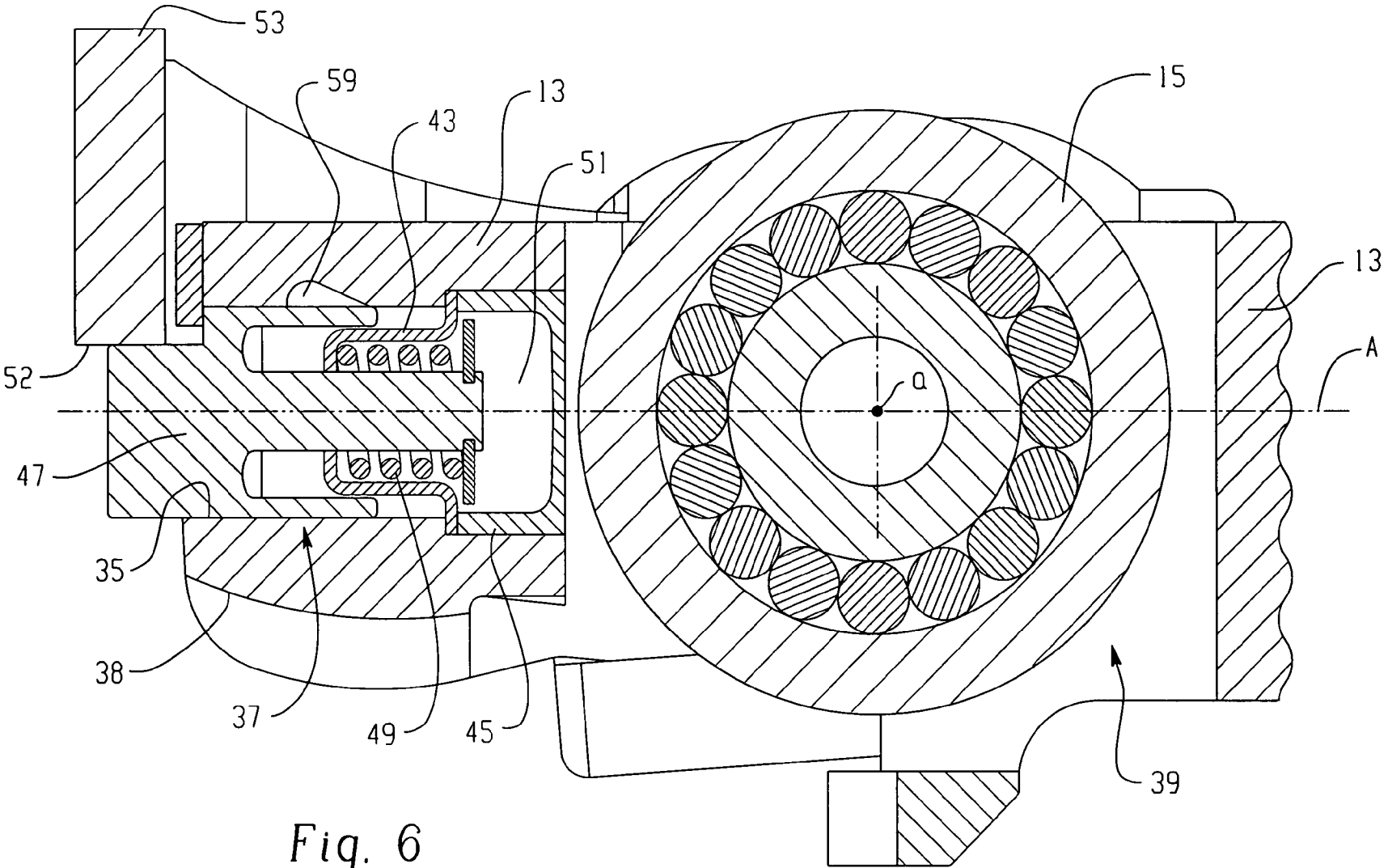
FIG. 6 is a greatly enlarged, fragmentary, axial cross-section, on a "vertical" plane, showing in greater detail the latch mechanism which comprises one aspect of the present invention.

Referring now primarily to FIG. 6, the latch assembly 37 includes a spring cage 43, seated against a shoulder formed by the latch bore 35, and with the spring cage 43 being trapped in the position shown by a latch bore plug 45, which is preferably pressed into the latch bore 35. Disposed within the latch bore 35, and axially movable therein, is a latch member 47, biased toward a retracted ("unlatched") position by a generally conical latch spring 49, which has its left end (in FIG. 6) seated against an adjacent surface of the spring cage 43. The latch assembly 37 defines a pressure chamber 51, which comprises the region within the latch bore 35, disposed axially between the latch bore plug 45 and the latch member 47. When pressurized fluid is communicated into the pressure chamber 51, the latch member 47 is biased to the left in FIG. 6, to the extended ("latched") position, generally parallel to an axis A defined by the inner rocker arm 13. In the latched position of the latch member 47, a flat, planar upper surface of the latch member 47 engages an adjacent lower surface 52 defined by an endwall 53 of the outer rocker arm 17 (see also FIG. 2).

Referring again primarily to FIGS. 3, 4 and 5, the inner rocker arm 13 defines an axially-extending (i.e., generally parallel to the axis A of the rocker arm 13) bore 55, an open end of which is visible in FIG. 3. As is best shown in FIG. 5, although somewhat schematically, an angled bore 57 is formed within, and defined wholly by, the inner rocker arm 13. By way of example only, the angled bore 57 may be formed by drilling, with the drill bit entering the inner rocker arm 13 from the circular opening 29, then proceeding until the bore 57 intersects the fulcrum surface 33 (or a bore extending somewhat vertically "upward" therefrom). The drill bit then continues until the resulting angled bore 57 is in open communication with the axially-extending bore 55. Preferably, but not necessarily, when the shaft 27 is inserted into the opening 29, the fit between the shaft 27 and the opening 29 is close enough (and perhaps even comprises a press-fit), such that the shaft 27 effectively "seals" the angled bore 57 from excessive fluid leakage. Those skilled in the art will understand that, for purposes of the present invention, absolute leakage-free sealing is not essential, but instead, all that is required is that the end of the angled bore 57 be sufficiently sealed to be able to build enough fluid pressure within the bore 55 and 57 to achieve the biasing of the latch member 47.

Referring now primarily to FIGS. 4, 5 and 6, another angled bore 59 is formed within, and defined wholly by, the inner rocker arm 13. In the same manner as for the angled bore 57, the angled bore 59 may be formed by drilling, with the drill bit entering the inner rocker arm 13 from above, and then through, the latch bore 35, then proceeding until the angled bore 59 is in open fluid communication with the axially-extending bore 55. Preferably, but not necessarily, the latch member 47 effectively "seals" the angled bore 59, although, as in the case of the angled bore 57, it is sufficient if the angled bore 59 is sealed enough such that pressure is able to build up within the pressure chamber 51, sufficient to bias the latch member 47 to the latched position shown in FIG. 6. It should be noted that, in FIG. 5, the reference numeral "59" appears twice, including a schematic (centerline) representation of the angled bore, and a physical representation where the angled bore 59 intersects the axially-extending bore 55. However, the angled bore 59 is also shown in FIG. 6, wherein just an upper terminal end of the bore 59, "above" the latch bore 35, is visible. It should be understood, when viewing FIG. 6, that the plane of the angled bore 59 does not coincide with the plane of FIG. 6, but instead is at an angle relative thereto.

Thus, by means of the series of bores just described, pressurized fluid is enabled to flow from above the ball plunger portion P "down" (in FIG. 4) through the angled bore 57, into the axially-extending bore 55, then flow to the left in FIG. 5, then flow "upward" (in FIG. 4) through the angled bore 59. The pressurized fluid in the bore 59 then flows into the pressure chamber 51, because the angled bore 59 intersects the latch bore 35 "behind" the plane of the drawing in FIG. 6. It should be noted that, in the appended claims, there will be reference made to a "fluid passage" (the axially-extending bore 55), having a "first end" (angled bore 57) in communication with the source of pressurized fluid, and a "second end" (the angled bore 59) in communication with the pressure chamber 51 of the latch mechanism.

Although not shown herein, it would be preferred to insert some sort of sealing ball or plug into the left end (in FIG. 5) of the axially-extending bore 55. There may also be a need to insert a sealing ball or plug into the upper end of the angled bore 59. In accordance with one worthwhile aspect of the preferred embodiment of the invention, in spite of needing three separate bores (passages, etc.) to communicate pressurized fluid from the "source" of the pressurized fluid (ball plunger portion P) to the pressure chamber 51 of the latch mechanism 37, at only two locations (left end of bore 55 and upper end of bore 59) are any extra sealing members perhaps required. This particular feature is significant in connection with reducing the overall manufacturing cost, and time of assembly of the invention.

It should be understood by those skilled in the art that, although fluid communication from the HLA to the latch member is shown and described herein as being accomplished by means of the fluid bores 57, 55, and 59, the use of such an "integral" passage is not a limitation of the present invention. By way of example only, the required fluid communication could, within the scope of the invention, be accomplished by means of a separate tubular member, brazed or otherwise attached to the inner rocker arm 13 at two spaced apart locations, but providing fluid communication from the ball plunger portion P to the pressure chamber 51. All that is essential to the present invention is that no extra (not otherwise needed) mechanical structure be required to "transmit" the effect of fluid pressure from the source (at one end of the inner rocker arm 13) to the latch assembly 37 (at the axially opposite end).

Although the bore 55, 57 and 59 have been described above in connection with a forming process involving drilling of the bores, it should be understood that the invention is not so limited. For example, if the inner rocker arm 13 is formed as a powder metal part, the bores 55, 57 and 59 could be formed by inserted members which would be withdrawn from the PM die after the formation of the inner rocker arm, to allow the rocker arm to be removed from the die. Thus, those skilled in the art will understand that the particular method chosen to form the bore 55, 57 and 59 is not a significant feature of the invention, as long as pressurized fluid may be communicated from the fulcrum surface 33 to the pressure chamber 51.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve control system for an internal combustion engine of the type including a cylinder head, and a poppet valve moveable relative to the cylinder head between open and closed positions, and a camshaft having a first cam profile and a second cam profile formed thereon; said valve system comprising a rocker arm assembly including a first rocker arm having a first cam follower in engagement with the first cam profile, and a second rocker arm having a second cam follower in engagement with the second cam profile; said valve control system further comprising the cylinder head including a fulcrum location operable to provide a source of pressurized fluid; said first rocker arm defining, toward a first axial end thereof, a fulcrum surface, adapted for pivotal engagement with said fulcrum location; said first rocker arm further defining, adjacent said fulcrum surface a pivot location whereby said second rocker arm pivots relative to said first rocker arm about said pivot location; said first rocker arm includes, toward a second axial end thereof, a latch assembly including a latch member moveable between latched and unlatched conditions relative to a latch surface defined by an adjacent portion of said second rocker arm; a spring biasing said latch member toward one of said latched and unlatched conditions, and said latch assembly defining a pressure chamber (51) operable to bias said latch member toward the other of said latched and unlatched conditions; characterized by:

said rocker arm assembly comprising a means for biasing said first rocker arm toward an out-of-latching-contact condition, relative to said second rocker arm;

said first rocker arm defining a fluid passage having a first end in open fluid communication with said fulcrum surface, said first end of said fluid passage being operable to receive pressurized fluid from said source; and said fluid passage having a second end in open fluid communication with said pressure chamber of said latch assembly.

2. A valve control system as claimed in claim 1, characterized by said biasing means is operably associated with said pivot location, thereby reducing the inertia of said biasing means during operation of said valve control system.

3. A valve control system for an internal combustion engine of the type including a cylinder head, and a poppet valve moveable relative to the cylinder head between open and closed positions, and a camshaft having a first cam profile and a second cam profile formed thereon; said valve control system comprising a rocker arm assembly including a first rocker arm having a first cam follower in engagement with the first cam profile, and a second rocker arm having a second cam follower in engagement with the second cam profile; said valve control system further comprising the cylinder head including a fulcrum location operable to provide a source of pressurized fluid; said first rocker arm defining, toward a first axial end thereof, a fulcrum surface, adapted for pivotal engagement with said fulcrum location; said first rocker arm further defining, adjacent said fulcrum surface a pivot location whereby said second rocker arm pivots relative to said first rocker arm about said pivot location; said first rocker arm includes, toward a second axial end thereof, a latch assembly including a latch member moveable between latched and unlatched conditions relative to a latch surface defined by an adjacent portion of said second rocker arm; a spring biasing said latch member toward one of said latched and unlatched conditions, and said latch assembly defining a pressure chamber (51) operable to bias said latch member toward the other of said latched and unlatched conditions; characterized by:

said first rocker arm defining a fluid passage having a first end in open fluid communication with said fulcrum surface, said first end of said fluid passage being operable to receive pressurized fluid from said source;

said fluid passage having a second end in open fluid communication with said pressure chamber of said latch assembly; and said pivot location comprising said first rocker arm defining a first opening, said second rocker arm defining a second opening aligned with said first opening, and a pivot member received within both said first and second openings.

4. A valve control system as claimed in claim 3, characterized by said rocker arm assembly comprising a means for biasing said first rocker arm toward an out-of-latching-contact condition, relative to said second rocker arm, said biasing means comprising a torsion spring assembly operably associated with said pivot member, and including a first portion in engagement with said first rocker arm, and a second portion in engagement with a second rocker arm.

5. A valve control system for an internal combustion engine of the type including a cylinder head, and a poppet valve moveable relative to the cylinder head between open and closed positions, and a camshaft having a first cam profile and a second cam profile formed thereon: said valve control system comprising a rocker arm assembly including a first rocker arm having a first cam follower in engagement with the first cam profile, and a second rocker arm having a second cam follower in engagement with the second cam profile; said valve control system further comprising the cylinder head including a fulcrum location operable to provide a source of pressurized fluid; said first rocker arm defining, toward a first axial end thereof, a fulcrum surface, adapted for pivotal engagement with said fulcrum location; said first rocker arm further defining, adjacent said fulcrum surface a pivot location whereby said second rocker arm pivots relative to said first rocker arm about said pivot location; said first rocker arm includes, toward a second axial end thereof, a latch assembly including a latch member moveable between latched and unlatched conditions relative to a latch surface defined by an adjacent portion of said second rocker arm; a spring biasing said latch member toward one of said latched and unlatched conditions, and said latch assembly defining a pressure chamber (51) operable to bias said latch member toward the other of said latched and unlatched conditions; characterized by:

said first rocker arm defining a fluid passage having a first end in open fluid communication with said fulcrum surface, said first end of said fluid passage being operable to receive pressurized fluid from said source;

said first rocker arm also defining an axis perpendicular to an axis defined by said first cam follower, said fluid passage comprising a main passage portion oriented generally parallel to said axis of said first rocker arm; and said fluid passage having a second end in open fluid communication with said pressure chamber of said latch assembly.

6. A valve control system as claimed in claim 5, characterized by said pivot location comprises said first rocker arm defining a cylindrical opening defining an axis oriented generally parallel to said axis of said first cam follower, said first end of said fluid passage comprising an angled passage communicating between said main passage portion and said cylindrical opening, said first end of said fluid passage being closed off by a cylindrical pivot member disposed in said cylindrical opening.

7. A valve control system as claimed In claim 5, characterized by said latch member of said latch assembly being disposed to move along said axis of said first rocker arm as said latch member moves between said latched and unlatched conditions.

8. A valve control system as claimed in claim 7, characterized by said second end of said fluid passage comprising an angled passage, said latch assembly comprises a bore concentric about said axis of said first rocker arm and slidably receiving said latch member therein, said angled passage intersecting said bore, whereby said second end of said fluid passage is intersected by said latch member.

* * * * *